US006324997B1

(12) United States Patent
Baker

(10) Patent No.: US 6,324,997 B1
(45) Date of Patent: Dec. 4, 2001

(54) CONNECTABLE EVENT TABLES

(76) Inventor: Gary Baker, 1100 Skyline, North Little Rock, AR (US) 72116

( * ) Notice: Subject to any disclaimer, the term of this patent is extended or adjusted under 35 U.S.C. 154(b) by 0 days.

(21) Appl. No.: 09/695,542

(22) Filed: Oct. 23, 2000

(51) Int. Cl.[7] ..... A47B 57/00
(52) U.S. Cl. ..... 108/64; 108/77
(58) Field of Search ..... 108/64, 69, 77, 108/65, 116, 117, 132

(56) References Cited

U.S. PATENT DOCUMENTS 2,857,223 * 10/1958 Furey ..... 108/64
3,915,100 * 10/1975 Sullivan ..... 108/64
4,750,432 * 6/1988 McNamara et al. ..... 108/69
5,144,888 * 9/1992 Heine et al. ..... 108/64
5,341,749 * 8/1994 Noakes ..... 108/64
5,438,937 * 8/1995 Ball et al. ..... 108/64
5,560,302 * 10/1996 Diffrient et al. ..... 108/64
5,678,948 * 10/1997 White ..... 108/64 X
6,041,722 * 3/2000 Baker ..... 108/64 X

* cited by examiner

*Primary Examiner*—Jose V. Chen
(74) *Attorney, Agent, or Firm*—Dennis B. Haase

(57) ABSTRACT

A train of like event tables in which a height adjustment mechanism is provided which includes a locking device which must be pulled to release. There is further provided a latch mechanism which selectively supports leaves hingeably attached to the top of each of the tables, or inter connects adjacent tables to form a train.

11 Claims, 4 Drawing Sheets

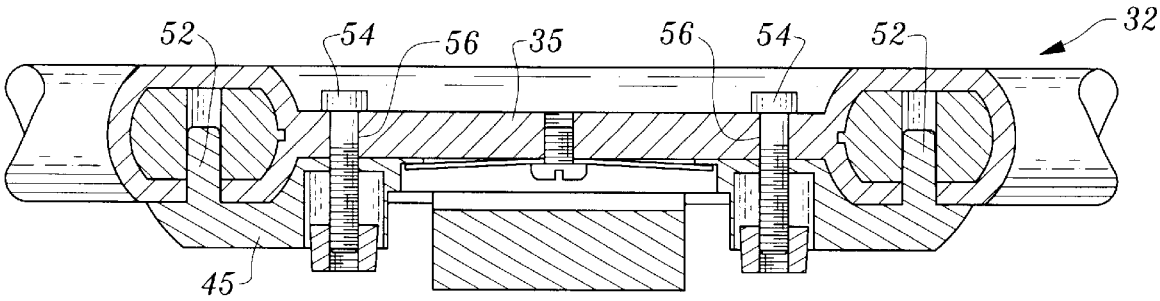
Fig. 3
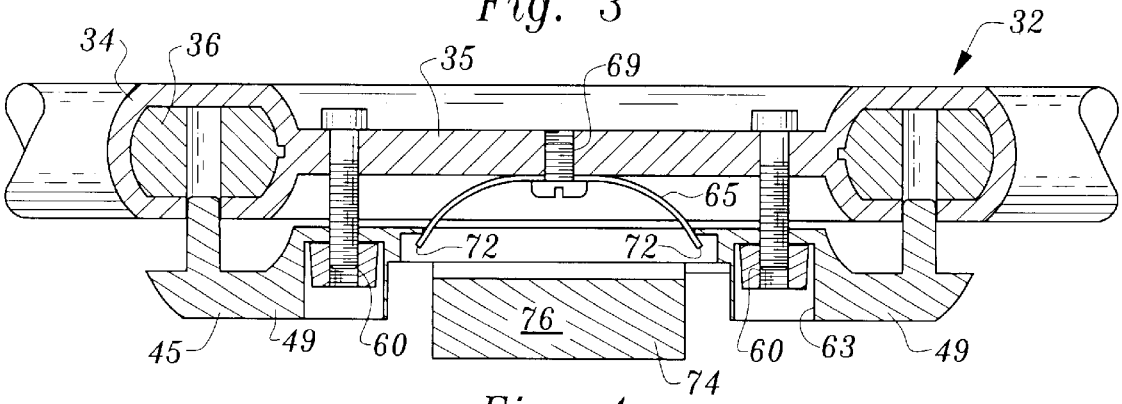
Fig. 4
Fig. 5
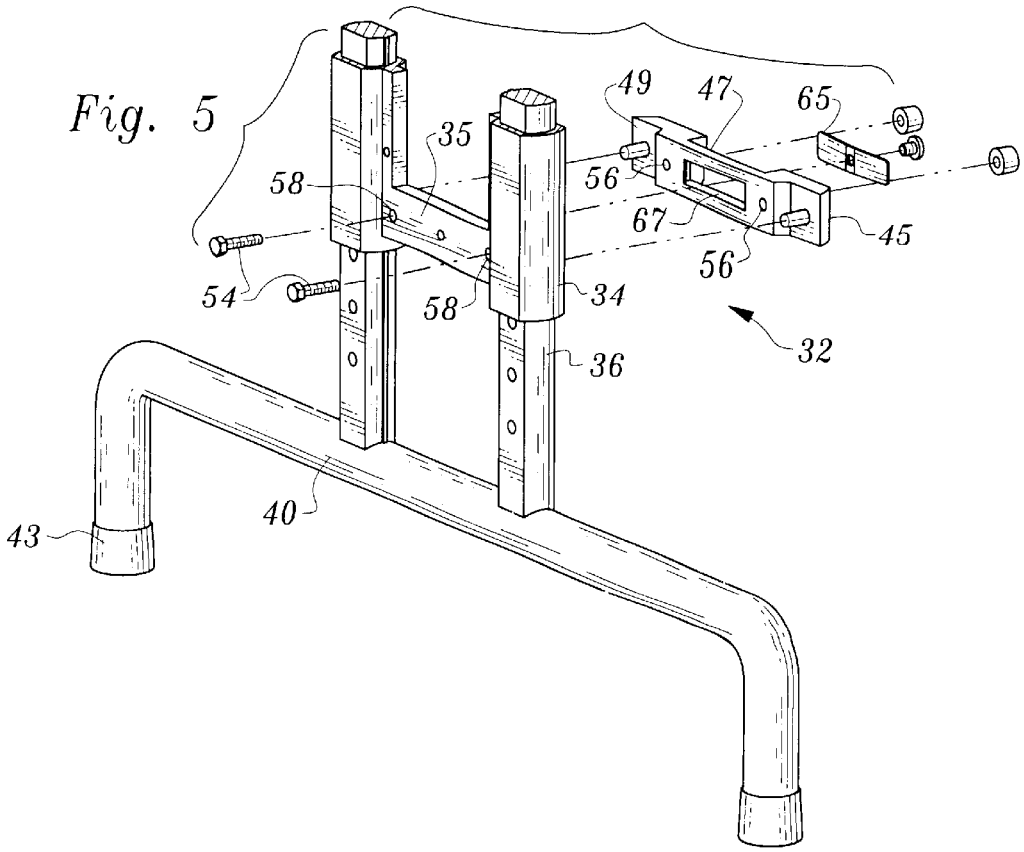

CONNECTABLE EVENT TABLES

The present invention relates to certain further improvements in event tables such as that which is the subject of my U.S. Pat. No. 6,041,722 and, more particularly, to improvements in extensible elements such as the legs of the subject table and the leaves thereof, coupled with a novel means of interconnecting like tables to form a train thereof.

BACKGROUND OF THE INVENTION

1. Field of the Invention

As chronicled in the above referenced '722 Patent, event tables proliferate, wherever folks assemble regularly. Every hotel, arena, meeting hall and lodge has at least several such tables, which they dutifully assemble and disassemble for each event; push them together or pull them apart as needed, and cover up the seams with table cloths.

The referenced '722 Patent, perhaps the latest innovation to come to the event business in several years, as good as it is, lends itself to further improvement, particularly in areas which reduce the cost of manufacture while increasing efficiency and safety.

To that end, the present invention is directed to adjustable devices which accomplish that end, while permitting much of the hardware to be cast rather than fabricated, resulting in considerable savings in cost.

2. Overview of the Prior Art

As is evident from a cursory review of the art recited in, and with respect to, the aforesaid '722 patent, advances in event tables are few and far between. There seems to be a benign acceptance within the field that the square-to-round table of Sullivan U.S. Pat. No. 4,646,654, at least until the advent of the '722 patent, was about as good as it gets. The appearance of the '722 patent has caused many in the industry to rethink their concepts.

The concept of interlocking tables was essentially a novelty until Baker '722 demonstrated how it could become practical. Others, such as Shettles U.S. Pat. No. 3,342,147, have made an early attempt at locking tables together rather than pushing them together, throwing a table cloth over them and hoping for the best.

Sapp U.S. Pat. No. 2,836,475 suggested, in 1958, that event tables be joined by means of a spring loaded pawl. Neither of these ideas took root.

Since the height of the event table was often dictated by the type of event, others, including Baker '722, directed their attention to the adjustability of the table legs. Ideas ranged from the most rudimentary telescoping legs of the ironing board of Teduschi U.S. Pat. No. 4,991,325, to the seemingly complex system of Terres et al. U.S. Pat. No. 4,949,649. Baker '722, over which the present invention constitutes a distinct improvement, settled for opposed spring loaded pins which were manually manipulated and required enough digital leverage to overcome the spring bias.

SUMMARY OF THE INVENTION

In the process of commercialization, one sometime learns that there are more efficient or effective ways to accomplish a given result. In the present instance, it has been learned that the apparatus for extending the Baker event table could be distinctly better, even though the methods taught were effective.

Accordingly, it is, generally speaking, the overall objective of the present invention to improve extensibility of the Baker table, both as to the height thereof, and the length.

It is another objective of the present invention to provide an improved mechanism for interlocking contiguous tables to increase the length thereof. Related to the foregoing is the objective of facilitating the interlocking of event tables so as to increase stability of the resultant chain while increasing efficiency.

A further objective of the present invention is to permit careful adjustment to the legs of the event table so as to more precisely and efficiently effect the appropriate height for any given event and to accomplish this objective with optimum safety.

The foregoing, as well as other objects and advantages of the improvements which comprise the present invention summarized hereinabove, will become more apparent by virtue of the following detailed description, taken in conjunction with the drawings made a part hereof, wherein:

DESCRIPTION OF THE FIGURES OF THE DRAWINGS

FIG. 3 is a view of the height adjustment mechanism and, in particular, the locking mechanism, taken along lines 3—3, partially sectioned to illustrate certain structural details thereof;

FIG. 4 is a view of the height adjustment mechanism in the same context as FIG. 3, but illustrating the locking mechanism in it "unlocked" position;

FIG. 5 is an exploded view of the locking mechanism referenced in FIGS. 3 and 4;

DETAILED DESCRIPTION OF A PREFERRED EMBODIMENT

Figure 2:
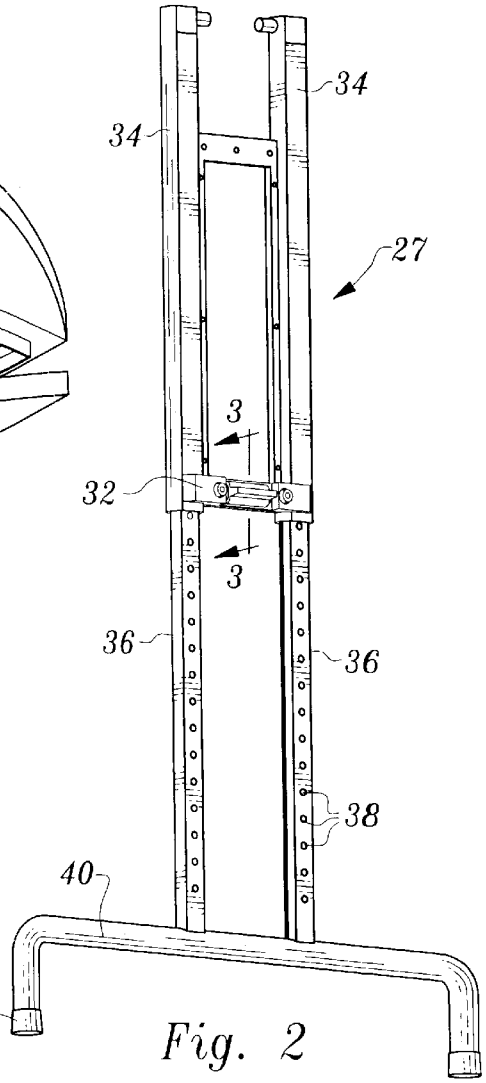
FiG. 2 is a side elevation of a portion of a table leg in its fully extended position.
Figure 1:
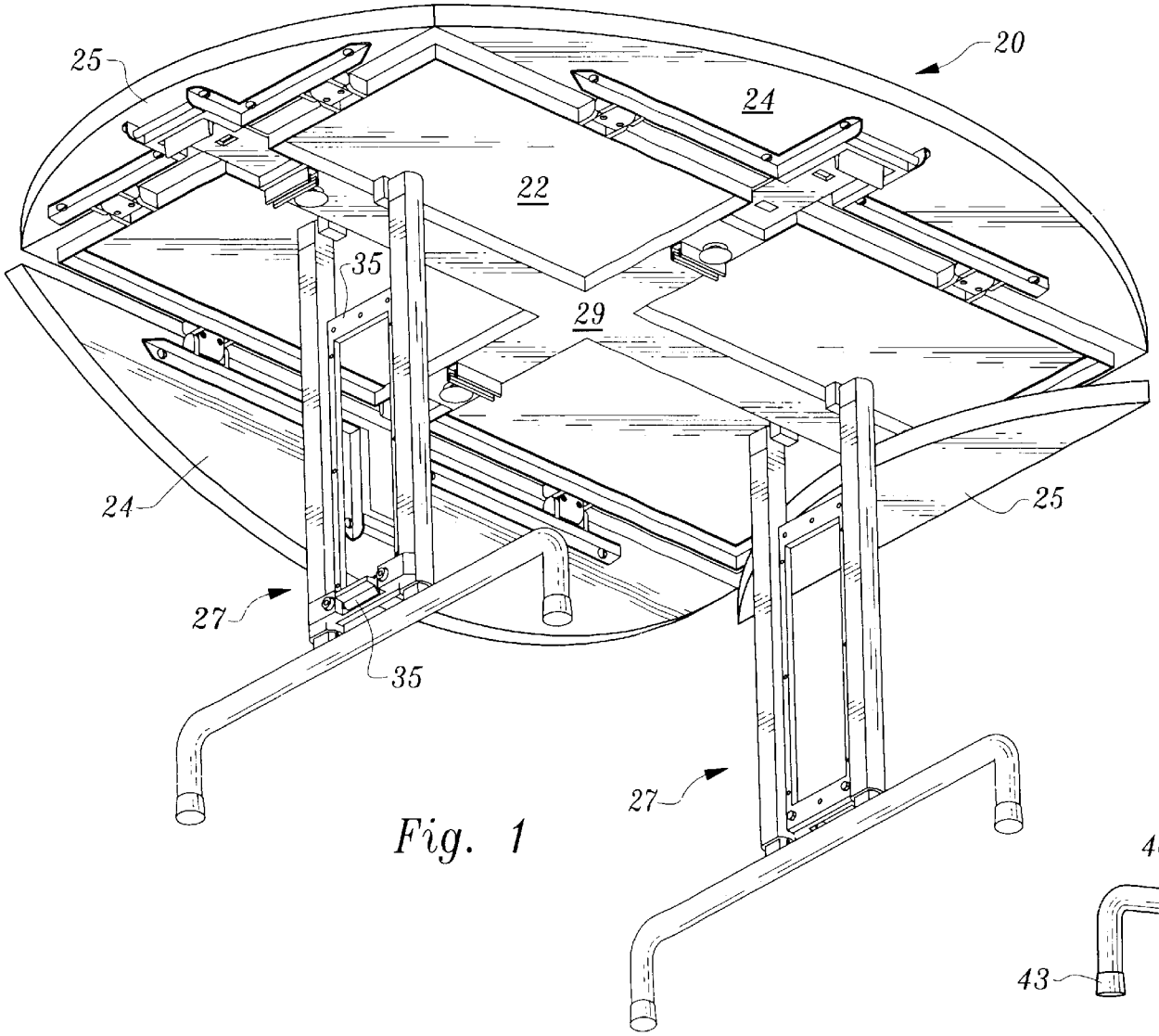
FIG. 1 is a view of the event table of the present invention, as seen in perspective from beneath the table, and illustrating the interrelationship of the various elements thereof blended to comprise a functional unit.

With reference now to the drawings, and initially to FIG. 1, an event table 20 is depicted, having certain improvements which constitute the substance of the invention.

The event table comprises a centrally disposed rectangular table top 22, unto which opposed pairs of leaves 24, 25 are hingedly attached. The event table 22 is supported on a pair of substantially identical legs 27, which are attached to a framework 29. The top 22 is secured to the frame 29, in any well known manner.

By virtue of its design, the frame may be readily cast, using an aluminum alloy rather than fabricated out of steel tubing or channel steel, which is commonplace in the event table business at this time. Thus, there is a significant saving in overall weight, which eases labor concerns, in addition to savings in manufacturing costs.

Moving now to FIGS. 2–5, there is depicted an improved device for selectively adjusting the height of each table, which embodies a novel locking mechanism for selectively permitting, and preventing, adjustment of the height of the table embodying novel features of the present invention, which accomplish the objectives attributed to it.

With reference to FIGS. 3–5, each leg comprises at least one, and as illustrated, two upstanding tubular posts 34 joined to define a unit by cross braces 35. Fifted in the posts 34, in telescoping relationship, are extensions 36. A series of pin holes 38 extend longitudinally along the extensions 36 at uniform intervals such as e.g., 1". A support base 40 is secured to the extensions at the lower terminus of the extensions and cups 43 affixed to the base provide anti skid protection. It will be appreciated that instead of the anti skid cups one may substitute casters or wheels, at least one of which is lockable to stabilize the table's position, without departure from the purposes of the invention.

The locking mechanism of the present invention is so constructed as to permit selective disengagement of the extension relative to the post for height adjustment in a manner which is relatively incapable of inadvertent release. In event tables which are currently in popular use, the locking mechanism is typically such that compression pressure on the mechanism is required to cause its release. Thus, a person sitting at the table could accidently bump the mechanism with, for example, their foot, and cause at least partial collapse of the structure. Workers assembling the table could have similar accidents, and the consequences of such a collapse could range from embarrassing to tragic.

The locking mechanism 32 of the present invention obviates the consequences of inadvertent release by requiring a positive pulling action to open the mechanism. To this end, a carrier 45 is provided, having a center section 47, flanked by offset end pieces 49. Each end piece 49 carries an inwardly facing latch pin 52. The end pieces 49 are positioned in alignment with the extensions 36, and the pins 52, are aligned with and sized to fit comfortably in the pin holes 38.

The carrier 45 is mounted, for limited reciprocal movement, to a brace by means of fasteners 54. The center section 47 of the carrier is formed with apertures 56, which are carefully aligned with companion apertures 58, drilled or otherwise formed in the cross brace so that the fasteners will readily pass through the brace and into the apertures 56 in the carrier 45. As best observed in FIGS. 3 and 4, the fasteners are of sufficient length as to permit limited reciprocal movement of the carrier relative to the brace, and spacer nuts are fitted into recesses 63 formed about the apertures 56 for that purpose. By virtue of the recesses, danger of torn clothing, or injury to bodily appendages, is minimized.

In order to normally, or continuously, bias the locking mechanism towards its locked position at all times, a leaf spring 65 is disposed in a window 67. A fastener 69 secures the center of the spring 65 to the cross brace 35 and the remote ends 72 extend through the window 67, pressing against the edges that define it. A grip, or handle 74, is secured to the carrier, and, by pulling on the grip, the carrier is moved away from the brace, causing the pins 52 to be pulled out of the pin holes 38, thereby releasing the extensions and permitting the leg's height to be adjusted. The grip may be provided with lateral serrations 76 on the surfaces thereof to enhance gripping.

Accordingly, rather than rely on compression, or the squeezing of fingers, to unlock, a pulling motion is required and is not, therefore, susceptible to inadvertent unlocking.

One of the more impressive features of the event table, which materially enhances its commercialization, is the capacity to interconnect several such like tables to form a train of such tables in any one of several event compatible configurations.

While some have sought to secure one table to another with pins manually inserted and locked in place from table to table, and others have used blocks connected to bungee cords, the improvement contemplated by the present invention provides a much simpler, yet more positive means of efficiently interconnecting such event tables.

Figure 6:
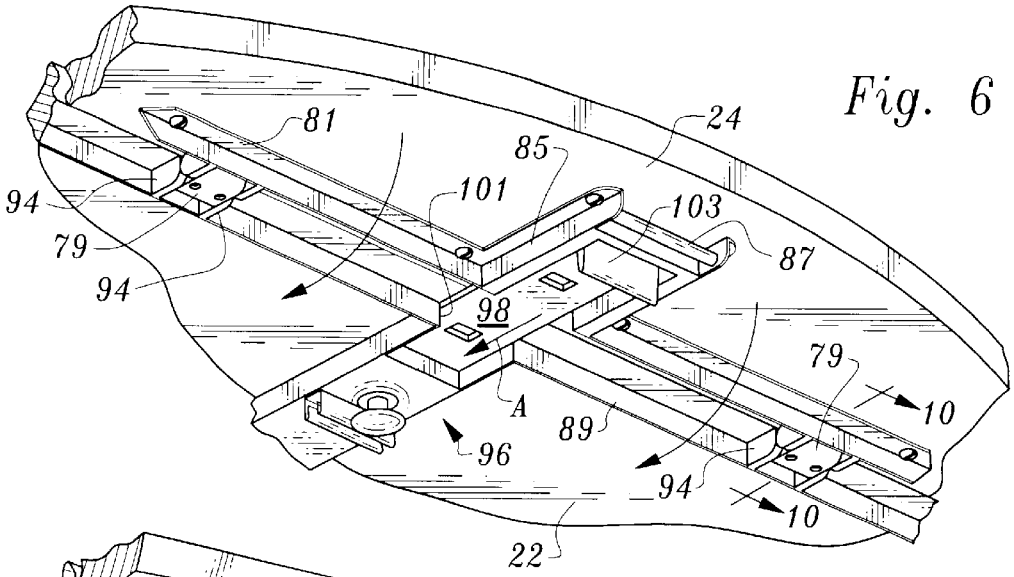
FIG. 6 is a view of the underside of the table, partially fragmented to illustrate the interrelationship of structural elements comprising the apparatus for the extension of the leaf and the interconnection of contiguous tables, shown in the "leaf up" latched position.
Figure 7:
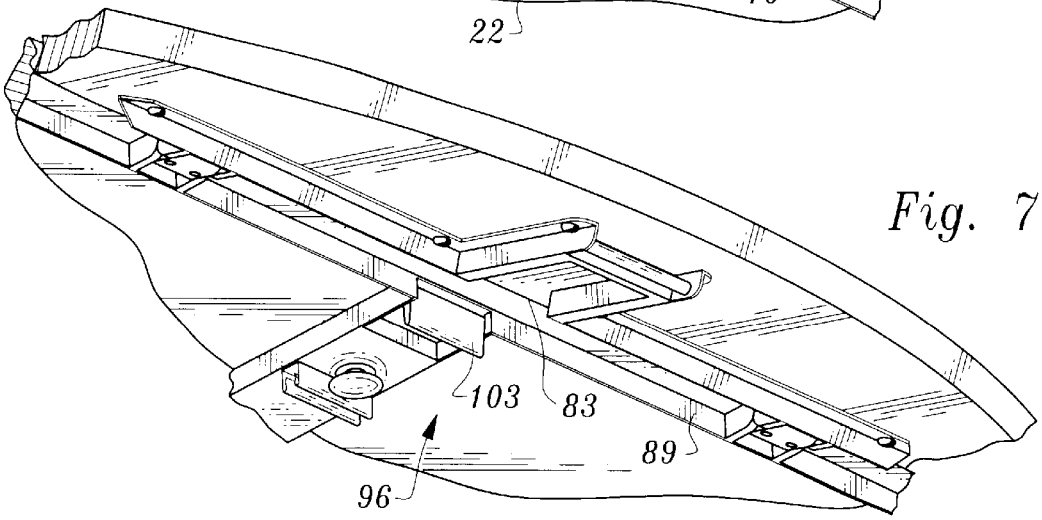
FIG. 7 is a view from the same position as FIG. 6 and showing the latch mechanism of the present invention in its retracted position with the leaf for which it provided support beginning to collapse.

Thus, with particular reference to FIGS. 6 through 11, and initially FIGS. 6 and 7, the underside of the table top 22 supports at least one leaf 24, which is hinged at 79 (FIG. 10) to the top 22. Realistically, leaves 24 surround the table top, where they may be extended to define a plurality of shapes.

In the configuration shown, there are two such hinges 79 for each leaf to permit it to be moved between an extended position and a stow position beneath the table top. Each such hinge is conjoined by a lateral support member 81, fastened in any suitable manner to the underside of each leaf 24. The central portion of the lateral support member is characterized by a slot 83 defined by parallel side bars 85, joined, or tied, at their respective remote ends by an end bar 87.

A companion lateral support member 89 is secured beneath the table top 22 at or near the edge thereof, and faces the lateral support member 81 on the adjacent leaf. The companion lateral support member is secured to the table top 22, and positions the other section of each of the hinges 79, opposite the lateral support member 81 by supporting a hinge pin 92 between pairs of brackets 94.

A latch housing 96 is preferably formed integrally with the companion support 89, both of which, by virtue of their particular design, may be readily cast. It will be appreciated, however, that they may be separately formed without departure from the essentials of the invention.

The latch housing 96 supports latch 98 on a track 101 for reciprocal movement longitudinally of the housing in the direction of the arrow A on FIG. 6. The latch includes a finger grip 103 which is readily accessed by the user to move the latch 98 along its longitudinal path.

The latch housing 96 is preferably centrally disposed relative to the table top and, as exemplified in FIGS. 6 and 7, longitudinally aligned with the slot 83 in order that the latch may be moved into and from the slot, as is illustrated graphically in FIGS. 6 and 7. With the latch in the position seen in FIG. 6, the latch supports the leaf 24 in its extended position, and, as seen in FIG. 7, the leaf is capable of being folded down and under the table top in a stow position.

Figure 8:
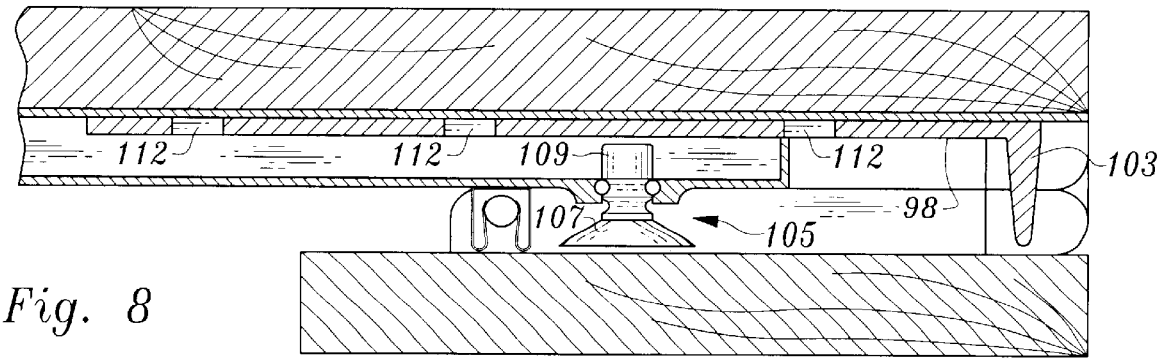
FIG. 8 is a fragmented and partially sectioned side elevation of an edge of the event table of the present invention, with a leaf fully folded under, and showing the interrelationship of the various elements of the improved latching mechanism, which is nested between the table top and the leaf.

In order to secure the position of the latch relative to the latch housing 96, a safety pin assembly 105, perhaps best seen in FIG. 8, includes a reciprocal pin 107, which terminates within the housing in a rectangular tang 109. Several rectangular apertures 112 are formed in the latch and are longitudinally aligned with the pin assembly to receive, in close fitting relation, the tang 109.

The latch mechanism 98, in keeping with the objectives of the present invention, serves multiple purposes. When not supporting a leaf, for example, the latch may be extended, as perhaps best illustrated in FIG. 11, to assist in the inter engagement of like tables to define a stabilized train of such tables.

Figure 9:
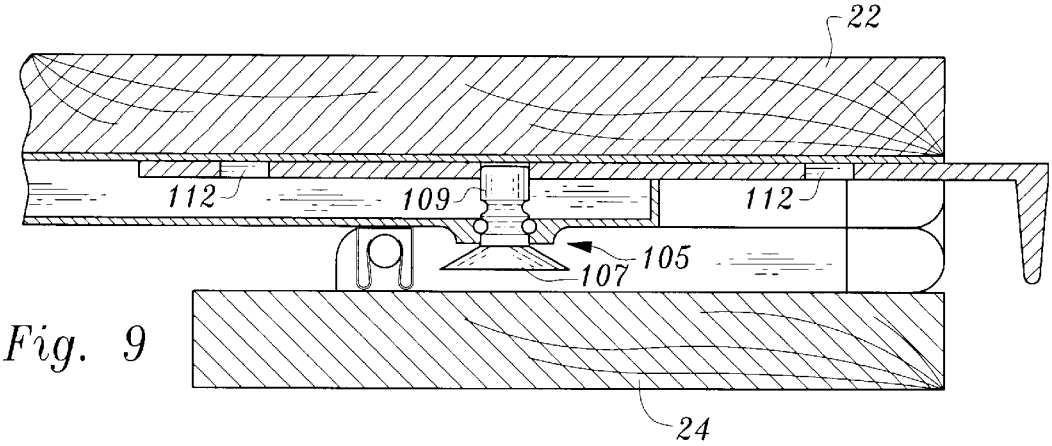
FIG. 9 is a view identical to FIG. 8, excepting that the latch mechanism is extended and positioned to engage a contiguous table.
Figure 10:
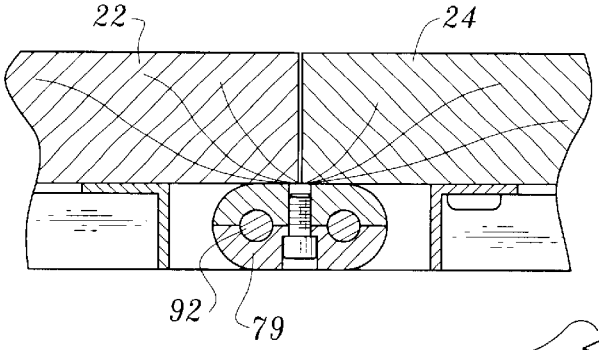
FIG. 10 is a fragmented sectional side elevation of the table of FIG. 1, taken along lines 10—10 of FIG. 6; and, FIG. 11, is a fragmented and partially sectioned view of a pair of tables constructed in accordance with the present invention as they would appear immediately prior to joinder.
Figure 11:
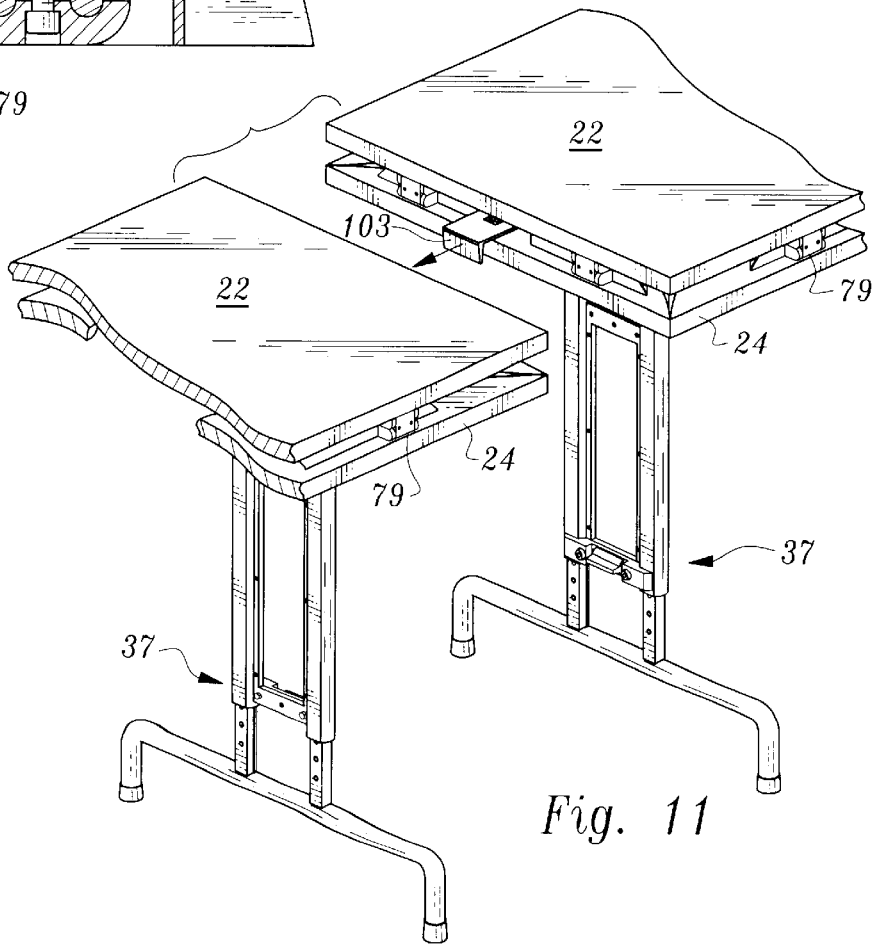

Referring primarily to FIG. 9, when the latch is retracted and the leaf 24 is folded to its stow position beneath the table top 22, (where it is held in place by a stop 114, of known construction) the track of the housing previously occupied by the latch becomes the slot into which the latch of a companion table is fitted in order to inter engage these adjacent tables.

Thus, by pulling out the latch on one table while retracting the latch on a contiguous table, the extended latch reposes in the slot previously occupied by the retracted latch and the two tables are readily engaged and conjoined in a stable train, secure against inadvertent relative movement, such as by bumping legs or other bodily appendages moving about the area trying to sit down, stand up, or engaged in animated conversation. In this manner, a stable environment is created for any given event.

Having now described, in considerable detail, the improvements which comprise the essence of the present invention, what is claimed is:

1. An event table capable of being joined with like tables to form a train, wherein each said table includes a top and leaves hingeably attached to the edges of said top for movement between an extended position and a stowed position;

each said table including means for height adjustment of said table and engagement means for selectively inter engaging like said tables in a stable train of like tables;

said height adjustment means including a pair of legs, each of said legs having posts, extensions telescopingly received in said posts, and a locking mechanism for selectively fixing the position of said extension relative to said post;

said locking mechanism being pulled to disengage said extension from said post to permit adjustment thereof; and, said engagement means including a latch, said latch being mounted beneath said table top and selectively slidable to a position in which at least a portion of said latch extends beyond said edge of said table top; a slot formed beneath each said leaf, said slot being axially aligned with said latch that when said latch is slidable beyond said edge of said table top a portion thereof moves into said slot to provide support for said leaf extended; and when said leaf is in its stowed position, said latch is selectively movable into said slot of a like table configuration with said table top.

2. The invention as taught in claim 1, wherein said latch is mounted in a housing, said housing being disposed beneath said table top.

3. The invention as taught in claim 2, wherein said latch is formed with a series of apertures aligned along its length; a pin assembly, said pin assembly disposed in said housing in alignment with said series of apertures, said pin assembly having a pin, said pin being receivable in said apertures, and said pin being movable toward and away from said apertures to selectively secure the position thereof relative to said table top.

4. The invention as taught in claim 3, wherein said extension is formed with a series of pin holes, said post having at least one pin hole therein, said pin hole in said post being aligned with said series of pin holes;

a carrier; said carrier having at least one pin affixed thereto and so positioned as to be selectively insertable in said pin holes;

a spring, said spring being engaged with said carrier so as to normally bias said carrier toward said post in order that said pin is inserted in said pin holes, and a finger grip on said carrier, said finger grip being manually engageable so as to permit overcoming of said spring bias to thereby permit movement of said extension relative to said post.

5. The invention as taught in claim 2, wherein said extension is formed with a series of pin holes, said post having at least one pin hole therein, said pin hole in said post being aligned with said series of pin holes;

a carrier; said carrier having at least one pin affixed thereto and so positioned as to be selectively insertable in said pin holes;

a spring, said spring being engaged with said carrier so as to normally bias said carrier toward said post in order that said pin is inserted in said pin holes, and a finger grip on said carrier, said finger grip being manually engageable so as to permit overcoming of said spring bias to thereby permit movement of said extension relative to said post.

6. The invention as taught in claim 1, wherein said latch is manually movable, a finger grip positioned at an end of said latch, said finger grip facilitating movement of said latch relative to said slot.

7. The invention as taught in claim 6, wherein said extension is formed with a series of pin holes, said post having at least one pin hole therein, said pin hole in said post being aligned with said series of pin holes;

a carrier; said carrier having at least one pin affixed thereto and so positioned as to be selectively insertable in said pin holes;

a spring, said spring being engaged with said carrier so as to normally bias said carrier toward said post in order that said pin is inserted in said pin holes, and a finger grip on said carrier, said finger grip being manually engageable so as to permit overcoming of said spring bias to thereby permit movement of said extension relative to said post.

8. The height adjustment mechanism of claim 1, wherein said extension is formed with a series of pin holes, said post having at least one pin hole therein, said pin hole in said post being aligned with said series of pin holes;

a carrier; said carrier having at least one pin affixed thereto and so positioned as to be selectively insertable in said pin holes;

a spring, said spring being engaged with said carrier so as to normally bias said carrier toward said post in order that said pin is inserted in said pin holes, and a finger grip on said carrier, said finger grip being manually engageable so as to permit overcoming of said spring bias to thereby permit movement of said extension relative to said post.

9. The invention as taught in claim 8, wherein each said leg comprises two posts, said posts having extensions therein, a cross brace interconnecting said posts, and said carrier mounted for reciprocal movement on said cross brace.

10. The invention as taught in claim 8, wherein said spring is a leaf spring.

11. The invention as taught in claim 1, wherein a lateral support member is provided beneath each said leaf hingeably attached to said top of said table, said lateral support member defining a slot, said slot being open at the edge of said leaf adjacent the hinges in both its stowed and its extended position.

* * * * *